US008485646B2

(12) United States Patent
Yokoyama et al.

(10) Patent No.: US 8,485,646 B2
(45) Date of Patent: Jul. 16, 2013

(54) LIQUID EJECTING HEAD AND LIQUID EJECTING APPARATUS

(75) Inventors: Naoto Yokoyama, Suwa (JP); Eiju Hirai, Minamiminowa (JP)

(73) Assignee: Seiko Epson Corporation, Tokyo (JP)

( * ) Notice: Subject to any disclaimer, the term of this patent is extended or adjusted under 35 U.S.C. 154(b) by 56 days.

(21) Appl. No.: 13/155,712

(22) Filed: Jun. 8, 2011

(65) Prior Publication Data

US 2011/0304662 A1 Dec. 15, 2011

(30) Foreign Application Priority Data

Jun. 10, 2010 (JP) ..... 2010-132699

(51) Int. Cl.
*B41J 2/045* (2006.01)

(52) U.S. Cl.
USPC ..... 347/68

(58) Field of Classification Search
CPC ..... B41J 2/14233; B41J 2002/14241
USPC ..... 347/9, 58, 59, 68, 70–72
See application file for complete search history.

(56) References Cited

U.S. PATENT DOCUMENTS 7,589,450 B2 * 9/2009 Takabe et al. ..... 310/311

FOREIGN PATENT DOCUMENTS

JP 2008-159735 A 7/2008

* cited by examiner

*Primary Examiner* — An Do
(74) *Attorney, Agent, or Firm* — Kilpatrick Townsend & Stockton LLP

(57) ABSTRACT

A liquid ejecting head includes: a piezoelectric actuator having a first electrode, a piezoelectric body formed on the upper side of the first electrode, and a second electrode formed on the upper side of the piezoelectric body; and an electrostatic actuator having the second electrode and a third electrode arranged to face the second electrode with a space therebetween.

12 Claims, 8 Drawing Sheets

LIQUID EJECTING HEAD AND LIQUID EJECTING APPARATUS

This application claims a priority to Japanese Patent Application No. 2010-132699 filed on Jun. 10, 2010 which is hereby expressly incorporated by reference herein in its entirety.

BACKGROUND

1. Technical Field

The present invention relates to liquid ejecting heads and liquid ejecting apparatuses.

2. Related Art

A liquid ejecting head as a constituent of a liquid ejecting apparatus is used, for example, in an ink jet printer or the like. In this case, the liquid ejecting head is used to discharge ink droplets, whereby the ink jet printer carries out printing by causing the ink to adhere on a medium such as paper.

A liquid ejecting head generally has an actuator that applies pressure on liquid so as to discharge a liquid through a nozzle opening. An actuator including a piezoelectric element is an example of such actuator. A piezoelectric element of such actuator includes a piezoelectric material that provides an electromechanical transduction function, for example, a piezoelectric body made of crystallized piezoelectric ceramics or the like, and two electrodes sandwiching the piezoelectric material. This type of piezoelectric element can deform when a voltage is applied thereto using the two electrodes. The liquid ejecting head uses this deformation to pressurize the inside of a pressure chamber so as to discharge ink droplets (see JP-A-2008-159735).

A liquid ejecting head having a high liquid discharge performance is needed for a liquid ejecting apparatus which is used in an ink jet printer or the like.

SUMMARY

An advantage of some aspects of the invention is to provide a liquid ejecting head having a high liquid discharge performance. Further, another advantage of some aspects of the invention is to provide a liquid ejecting apparatus including the above-mentioned liquid ejecting head.

A liquid ejecting head according to an aspect of the invention includes: a piezoelectric actuator having a first electrode, a piezoelectric body that is formed on a side of the first electrode in a first direction vertical to a surface of the first electrode, and a second electrode that is formed on a side of the piezoelectric body in the first direction; and an electrostatic actuator having the second electrode and a third electrode arranged to face the second electrode with a space therebetween.

With this liquid ejecting head, the liquid discharge performance can be improved.

The liquid ejecting head according to the aspect of the invention may further include: a first substrate formed on a side of the piezoelectric actuator in a second direction which is opposite to the first direction; and a second substrate formed on a side of the piezoelectric actuator in the first direction. A passage that communicates with a nozzle opening is formed in the first substrate, a recess is formed on the piezoelectric actuator side of the second substrate, and the third electrode may be formed on a bottom surface of the recess.

With this liquid ejecting head, the third electrode can be formed on the bottom surface of the recess in the second substrate, which makes it possible to easily obtain a liquid ejecting head that has an electrostatic actuator.

The liquid ejecting head according to the aspect of the invention may further include a drive IC that applies voltages between the first and second electrodes and between the second and third electrodes.

With this liquid ejecting head, the liquid discharge performance can be improved.

In the liquid ejecting head according to the aspect of the invention, the drive IC may perform a first control operation in which the drive IC applies a voltage between the first and second electrodes so as to pressurize the inside of the passage and a second control operation in which the drive IC applies a voltage between the second and third electrodes so as to depressurize the inside of the passage.

With this liquid ejecting head, liquid is discharged using the piezoelectric actuator, whereas liquid is supplied into the passage using the electrostatic actuator. This makes it possible to improve a liquid discharge performance.

A liquid ejecting apparatus according to another aspect of the invention includes the liquid ejecting head according to the invention.

With this liquid ejecting apparatus, because the apparatus includes the liquid ejecting head according to the invention, the liquid discharge performance can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Descriptions of preferable exemplary embodiments will be given hereinafter with reference to the drawings.

1. Liquid Ejecting Head 1.1. Configuration of Liquid Ejecting Head

Figure 1:
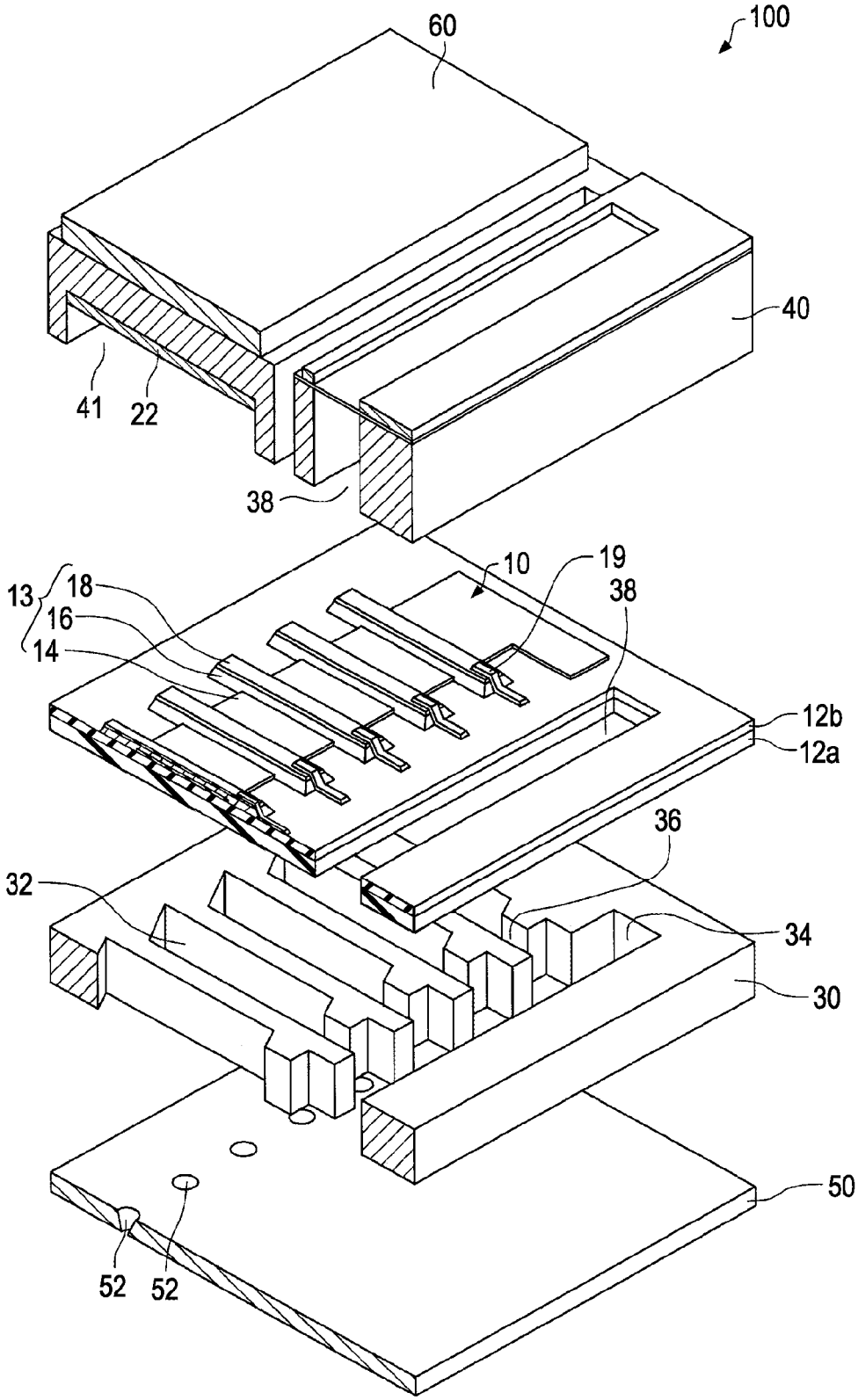
FIG. 1 is an exploded perspective view schematically illustrating a liquid ejecting head according to an embodiment of the invention.
Figure 2:
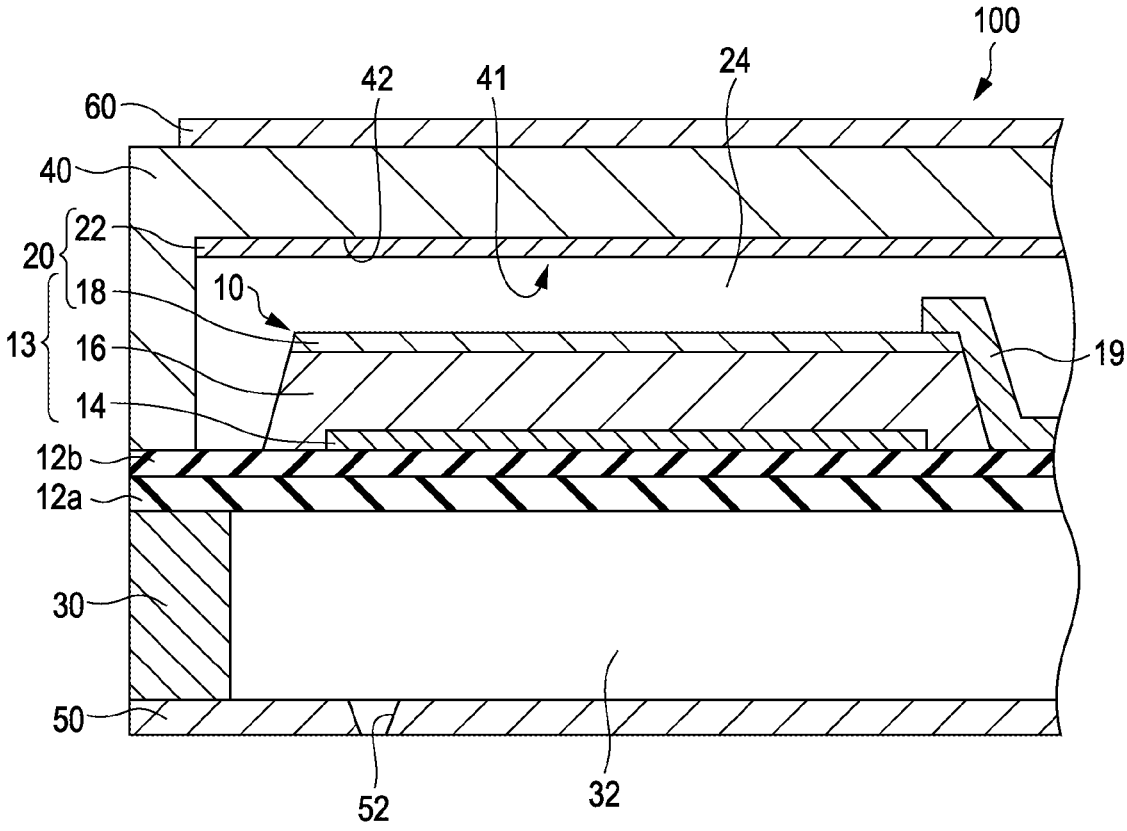
FIG. 2 is a cross-sectional view schematically illustrating the liquid ejecting head according to the embodiment of the invention.
Figure 3:
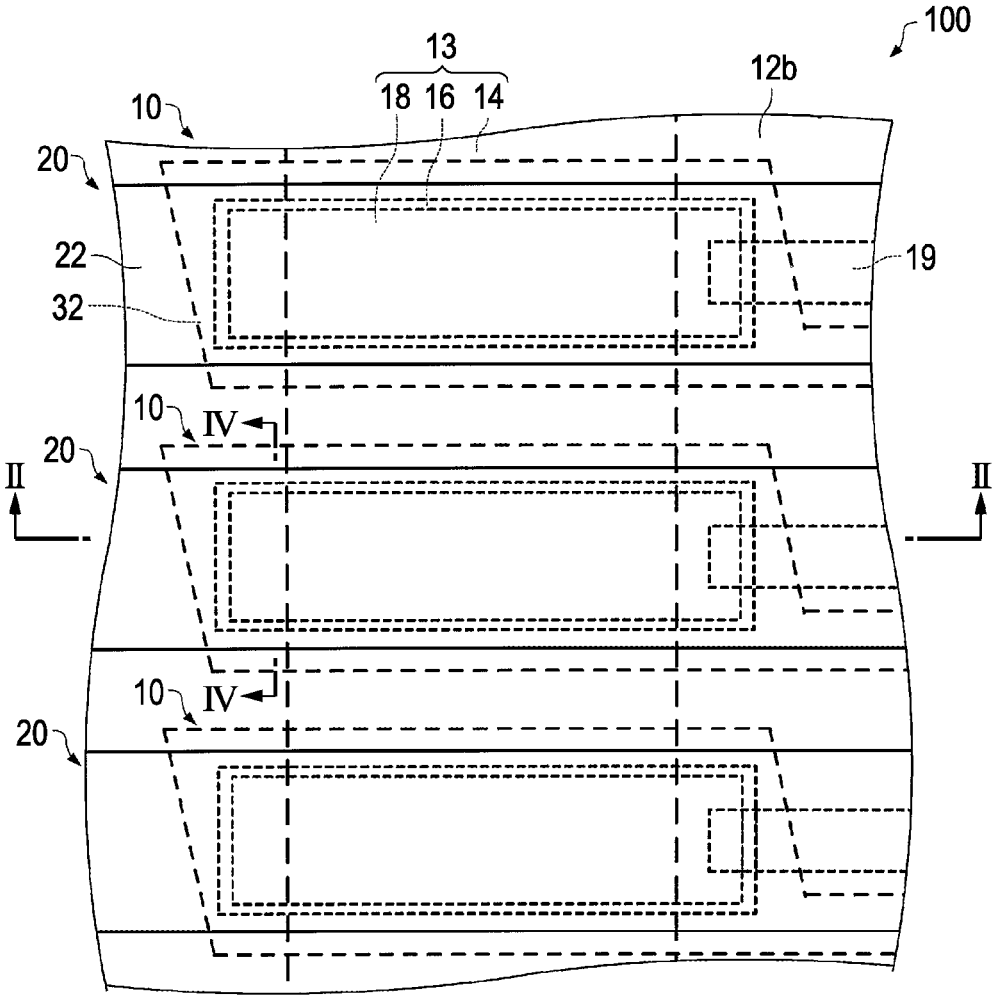
FIG. 3 is a plan view schematically illustrating the liquid ejecting head according to the embodiment of the invention.

First, a configuration of a liquid ejecting head according to an embodiment of the invention will be explained with reference to the drawings. FIG. 1 is an exploded perspective view schematically illustrating a liquid ejecting head 100 according to the embodiment. FIG. 2 is a cross-sectional view schematically illustrating the liquid ejecting head 100. FIG. 3 is a plan view schematically illustrating the liquid ejecting head 100. Note that FIG. 2 is a cross-sectional view taken along the line II-II in FIG. 3. A second substrate 40 and a drive IC 60 are not illustrated in FIG. 3 for the sake of convenience.

The liquid ejecting head 100, as illustrated in FIGS. 1 through 3, includes a piezoelectric actuator 10 and an electrostatic actuator 20. The liquid ejecting head 100 may further include a first substrate 30, the second substrate 40, a nozzle plate 50, and the drive IC 60.

The piezoelectric actuator 10 includes vibration plates 12*a* and 12*b*, and a piezoelectric element 13. The piezoelectric element 13 includes a first electrode 14, a piezoelectric body 16, and a second electrode 18. As illustrated in FIGS. 1 and 3, a plurality of piezoelectric actuators 10 are arranged corresponding to a plurality of pressure chambers 32 on a one-to-one basis.

The vibration plates 12*a* and 12*b* are formed on the first substrate 30. The vibration plates 12*a* and 12*b* are flexible and deform (bend) in accordance with operation of the piezoelectric body 16 so as to change the volume of the pressure chamber 32. Although two layers of the vibration plates 12*a* and 12*b* are provided as illustrated in the example in the drawings, the number of layers is not specifically limited thereto. Inorganic oxide such as zirconium oxide ($ZrO_2$), silicon nitride and silicon oxide, or alloy such as stainless steel can be exemplified as a material of the vibration plates 12*a* and 12*b*.

Although not illustrated in the drawings, the first electrode 14 may work as a vibration plate instead of providing the vibration plates 12*a* and 12*b*. In other words, the first electrode 14 may have two functions, i.e., a function to be one electrode that applies a voltage to the piezoelectric body 16, the other to be a vibration plate that deforms in accordance with operation of the piezoelectric body 16.

The first electrode 14 is formed on the vibration plate 12*b*. Between the first electrode 14 and the vibration plate 12*b*, a layer that provides adhesion to the two and a layer that provides strength and/or conductivity to the two may be formed. As examples of such layers, a layer made of various metals such as titanium, nickel, iridium and platinum and a layer made of an oxide of these metals can be cited.

The first electrode 14 is, for example, a layer or thin film in shape. The thickness of the first electrode 14 can be determined, for example, between 50 nm and 300 nm. The shape of the first electrode 14, when viewed from above, is not limited to a specific form as long as the piezoelectric body 16 can be disposed between the first electrode 14 and the second electrode 18 which is arranged opposing the first electrode 14. Therefore, the shape of the first electrode 14 may be rectangular, circular, or the like.

As a material of the first electrode 14, the following can be exemplified: various types of metal such as nickel, iridium and platinum, conductive oxide of these metals (e.g., iridium oxide), complex oxide of strontium and ruthenium (SrRuOx: SRO), complex oxide of lanthanum and nickel (LaNiOx: LNO), and so on. The first electrode 14 may have either a single-layer structure made of the material or a multilayer structure made of the multiple materials exemplified above.

The first electrode 14 being paired with the second electrode 18 serves as an electrode (a lower electrode formed, for example, under the piezoelectric body 16) to apply a voltage to the piezoelectric body 16. This is one of functions of the first electrode 14. The first electrode 14 is a common electrode for the plurality of actuators 10 as illustrated in the example in the drawings. The first electrode 14 is electrically connected to the drive IC 60 through a wire (not illustrated).

The piezoelectric body 16 is formed on the first electrode 14. To be more specific, the piezoelectric body 16 is formed, for example, on the upper surface and side surface of the first electrode 14, and also formed on the upper side of the vibration plate 12*b*. The thickness of the piezoelectric body 16 can be determined, for example, between 300 nm and 3,000 nm.

Because the piezoelectric body 16 is formed of piezoelectric material, the piezoelectric body 16 can deform when a voltage is applied thereto between the first electrode 14 and the second electrode 18. The deformation of the piezoelectric body 16 can cause the vibration plates 12*a* and 12*b* to deform (bend).

Perovskite oxide as indicated in a general expression of $ABO_3$ (where A includes Pb, B includes Zr and Ti, for example) is preferable as a material of the piezoelectric body 16. Specific examples of such material are lead zirconate titanate ($Pb(Zr,Ti)O_3$), barium titanate ($BaTiO_3$), potassium sodium niobate ($(K,Na)NbO_3$), and so on.

The second electrode 18 is formed on the piezoelectric body 16. The second electrode 18 is arranged so as to oppose the first electrode 14. The second electrode 18 is, for example, a layer or thin film in shape. The thickness of the second electrode 18 can be determined, for example, between 50 nm and 300 nm. The shape of the second electrode 18, when viewed from above, is not limited to a specific form as long as the piezoelectric body 16 can be disposed between the first electrode 14 and the second electrode 18 which is arranged opposing the first electrode 14. Therefore, the shape of the second electrode 18 may be rectangular, circular, or the like.

As a material of the second electrode 18, the following can be exemplified: various types of metal such as nickel, iridium and platinum, conductive oxide of these metals (e.g., iridium oxide), complex oxide of strontium and ruthenium (SrRuOx: SRO), complex oxide of lanthanum and nickel (LaNiOx: LNO), and so on. The second electrode 18 may have either a single-layer structure made of the material or a multilayer structure made of the multiple materials exemplified above.

The second electrode 18 serves as an electrode (an upper electrode formed on the upper side of the piezoelectric body 16, for example) to apply a voltage to the piezoelectric body 16. This is one of functions of the second electrode 18. The second electrode 18 is electrically connected to the drive IC 60 through a wire 19.

The electrostatic actuator 20 includes the second electrode 18 and a third electrode 22. A plurality of electrostatic actuators 20 are arranged corresponding to the plurality of piezoelectric actuators 10 on a one-to-one basis as illustrated in FIGS. 1 and 3.

The third electrode 22, as illustrated in FIGS. 1 and 2, is formed on a bottom surface 42 of a recess 41 that is formed in the second substrate 40. The third electrode 22 is arranged so as to oppose the second electrode 18 with a space 24 therebetween. A plurality of third electrodes 22 are arranged corresponding to the plurality of second electrodes 18 on a one-to-one basis. Although not illustrated in the drawings, a single third electrode 22 may be formed corresponding to the plurality of second electrodes 18. In other words, the third electrode 22 may be a common electrode for the plurality of electrostatic actuators 20. The third electrode 22 is electrically connected to the drive IC 60 through a wire (not illustrated), for example. In the electrostatic actuator 20, electrostatic force is generated between the second electrode 18 and the third electrode 22 by charging the second electrode 18 and the third electrode 22, which can cause the second electrode 18 to be pulled toward the third electrode 22.

As a material of the third electrode 22, the following can be exemplified: various types of metal such as nickel, iridium and platinum, conductive oxide of these metals (e.g., iridium oxide), complex oxide of strontium and ruthenium (SrRuOx: SRO), complex oxide of lanthanum and nickel (LaNiOx: LNO), indium tin oxide (ITO), and so on. The third electrode 22 may have either a single-layer structure made of the material or a multilayer structure made of the multiple materials exemplified above.

The first substrate 30 is formed under the piezoelectric actuator 10. Materials such as silicon and stainless steel (SUS) can be exemplified as a material of the first substrate 30. As illustrated in FIG. 1, a reservoir (liquid storage) 34, a supply channel 36 communicating with the reservoir 34, and the pressure chamber 32 communicating with the supply channel 36, are formed in the first substrate 30. The first substrate 30 partitions the space between the nozzle plate 50 and the vibration plate 12*a* so as to arrange the reservoir 34, the supply channel 36 and the pressure chamber 32. Although, in the drawings, the reservoir 34, the supply channel 36 and the pressure chamber 32 are described as different constituents from each other, all of these constituents are liquid passages and can be designed in any manner. For example, in the drawings, although the supply channel 36 is formed in a shape narrowing part of a passage, it can be formed in any shape based on the design. The nozzle plate 50, the first substrate 30 and the vibration plates 12*a* and 12*b* define the pressure chamber 32, the reservoir 34 and the supply channel 36. The reservoir 34 can temporarily store ink supplied from outside (e.g., from an ink cartridge) through a through-hole 38 arranged in the second substrate 40 and the vibration plates 12*a* and 12*b*. Ink in the reservoir 34 can be supplied to the pressure chamber 32 through the supply channel 36. The volume of the pressure chamber 32 changes according to deformation of the vibration plates 12*a* and 12*b*. The pressure chamber 32 communicates with a nozzle opening 52, and liquid such as ink is discharged through the nozzle opening 52 when the volume of the pressure chamber 32 changes.

The nozzle plate 50 includes the nozzle openings 52 through which ink is discharged. The plurality of nozzle openings 52 are arranged, for example, in a row in the nozzle plate 50. Materials such as silicon and stainless steel (SUS) can be exemplified as a material of the nozzle plate 50.

The second substrate 40 is formed over the piezoelectric actuator 10. The recess 41 is formed in the second substrate 40 so as to accommodate the piezoelectric element 13. Accordingly, the second substrate 40 functions as a sealing plate to seal the piezoelectric element 13 (a part of the piezoelectric actuator 10). The recess 41 is formed on the piezoelectric actuator 10 side of the second substrate 40. The second substrate 40 can protect the piezoelectric body 16 from the ambient atmosphere, for example. The third electrode 22 is formed on the bottom surface 42 of the recess 41 in the second substrate 40. Materials such as silicon, stainless steel (SUS) and glass can be exemplified as a material of the second substrate 40.

The drive IC 60 is formed on the second substrate 40. The drive IC 60 can drive the piezoelectric actuator 10 and the electrostatic actuator 20. To be more specific, the drive IC 60 applies a voltage between the first electrode 14 and the second electrode 18 (that is, gives a drive signal) so as to drive the piezoelectric actuator 10 (first control operation) and thereby pressurize the inside of the pressure chamber 32. Further, the drive IC 60 applies a voltage between the second electrode 18 and the third electrode 22 so as to drive the electrostatic actuator 20 (second control operation) and thereby depressurize the inside of the pressure chamber 32.

1.2. Operation of Liquid Ejecting Head

Figure 4A:
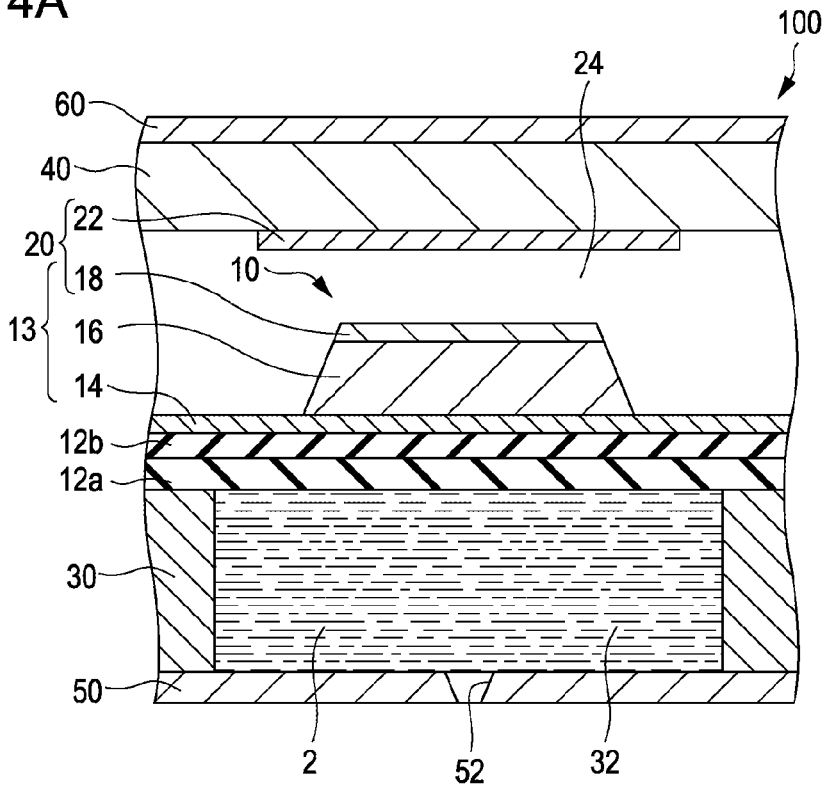
FIG. 4A is a diagram illustrating operation of the liquid ejection head according to the embodiment of the invention.
Figure 4B:
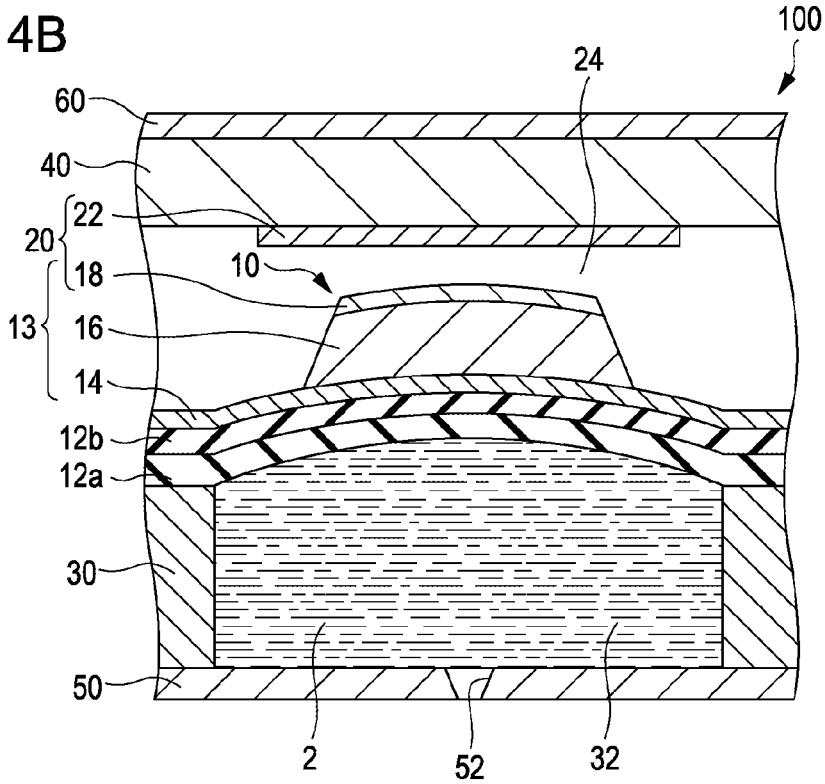
FIG. 4B is a diagram illustrating operation of the liquid ejecting head according to the embodiment of the invention.
Figure 4C:
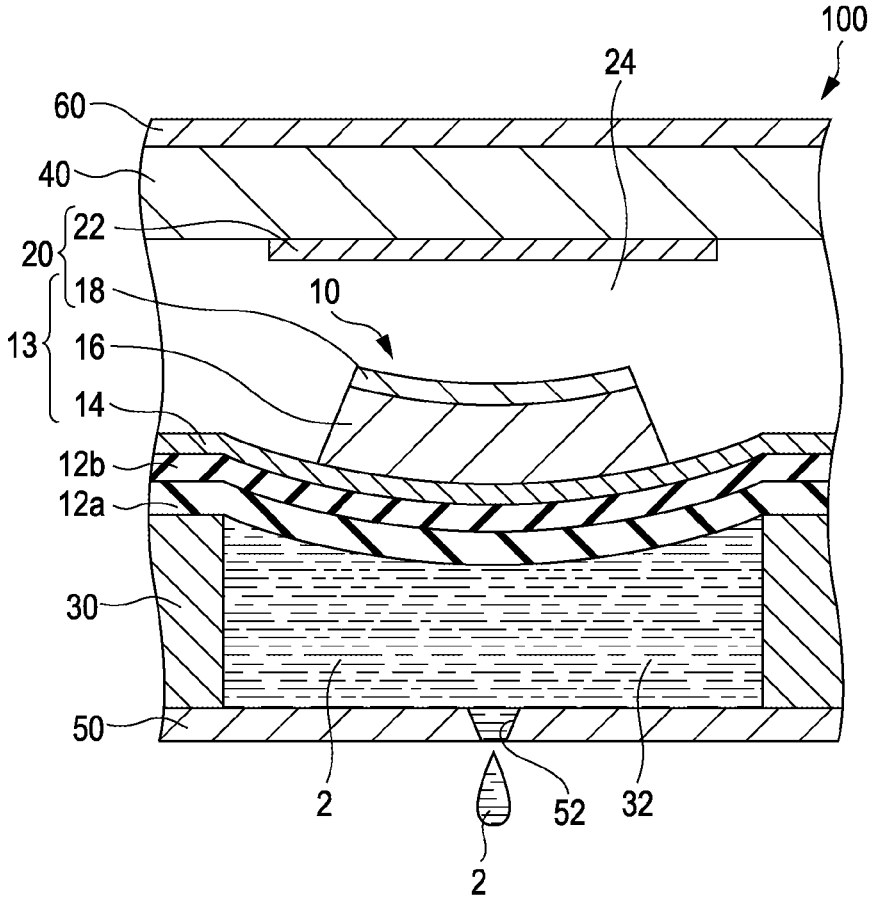
FIG. 4C is a diagram illustrating operation of the liquid ejecting head according to the embodiment of the invention.

Next, operation of the liquid ejecting head 100 will be explained with reference to the drawings. FIGS. 4A through 4C are diagrams illustrating operation of the liquid ejecting head 100. Note that FIGS. 4A through 4C are cross-sectional views taken along the line IV-IV in FIG. 3.

FIG. 4A indicates an initial state of the liquid ejecting head 100 (no voltage is applied to any of the first electrode 14, second electrode 18, and third electrode 22).

First, as illustrated in FIG. 4B, the electrostatic actuator 20 upwardly displaces the vibration plates 12*a* and 12*b*. More specifically, the drive IC 60 applies a voltage between the second electrode 18 and the third electrode 22 (gives a drive signal); the second electrode 18 is pulled toward the third electrode 22; thus the vibration plates 12*a* and 12*b* are displaced upward. The displacement of the vibration plates 12*a* and 12*b* causes the volume of the pressure chamber 32 to increase, which in turn depressurizes the inside of the pressure chamber 32 so that a liquid 2 is supplied into the pressure chamber 32.

Next, as illustrated in FIG. 4C, the piezoelectric actuator 10 downwardly displaces the vibration plates 12*a* and 12*b*. To be more specific, the drive IC 60 applies a voltage between the first electrode 14 and the second electrode 18 (gives a drive signal) so as to deform the piezoelectric body 16; thus the vibration plates 12*a* and 12*b* are displaced downward. The displacement of the vibration plates 12*a* and 12*b* causes the volume of the pressure chamber 32 to decrease, which in turn pressurizes the inside of the pressure chamber 32 so that the liquid 2 is discharged through the nozzle opening 52.

The liquid 2 is intermittently discharged from the liquid ejecting head 100 by repeating the above-mentioned operation.

1.3. Operation Effects and Others

The piezoelectric actuator 10 and the electrostatic actuator 20 may be included in the liquid ejecting head 100. This allows a degree of displacement of the vibration plates 12*a* and 12*b* to increase in comparison with a liquid ejecting head that has a piezoelectric actuator alone. That is, since the amount of change in volume of the pressure chamber (passage) 32 is made larger, a liquid discharge performance can be improved. Accordingly, even if piezoelectric material whose distortion amount is small (e.g., non-lead-based piezoelectric material) is employed as the piezoelectric body 16, it is possible to obtain a liquid ejecting head with a high liquid discharge performance.

Specifically, in the case of a liquid ejecting head that has a piezoelectric actuator alone, a process illustrated in FIG. 4C is carried out in which the piezoelectric actuator downwardly displaces vibration plates to discharge liquid. Subsequently, a process illustrated in FIG. 4A is carried out in which the vibration plates are returned to the initial state without the application of a voltage to the piezoelectric actuator to supply liquid into the pressure chamber. On the other hand, in the case of the liquid ejecting head 100, as illustrated in FIGS. 4A through 4C, a process illustrated in FIG. 4B is carried out in which the electrostatic actuator 20 upwardly displaces the vibration plates 12*a* and 12*b* to supply the liquid 2 into the pressure chamber 32. Subsequently, a process illustrated in FIG. 4C can be carried out in which the piezoelectric actuator 10 downwardly displaces the vibration plates 12*a* and 12*b* to discharge the liquid 2. In this manner, the liquid ejecting head 100 can upwardly displace the vibration plates 12*a* and 12*b* using the electrostatic actuator 20. Accordingly, the liquid ejecting head 100 can allow the degree of displacement of the vibration plates 12*a* and 12*b* to increase in comparison with the liquid ejecting head that has the piezoelectric actuator alone.

Further, the liquid ejecting head 100 is configured to have the third electrode 22 formed on the bottom surface 42 of the recess 41 in the second substrate 40. The second substrate 40 is a material to seal the piezoelectric element 13 (a part of the piezoelectric actuator 10). Therefore, the third electrode 22 can be formed so as to oppose the second electrode 18 without providing additional material on which the third electrode 22 is formed. That is, with the liquid ejecting head 100, the liquid ejecting head including the electrostatic actuator 20 can be obtained with ease.

An example in which the liquid ejecting head 100 is an ink jet recording head has been described. However, the liquid ejecting head according to the embodiment can be used as, for example, a coloring material ejecting head used in the manufacture of color filters of liquid crystal displays or the like, an electrode material ejecting head used in the formation of electrodes of organic EL displays, surface light emission displays (FEDs) or the like, a bioorganic matter ejecting head used in the manufacture of biochips, and so on.

2. Method for Manufacturing Liquid Ejecting Head

Figure 5:
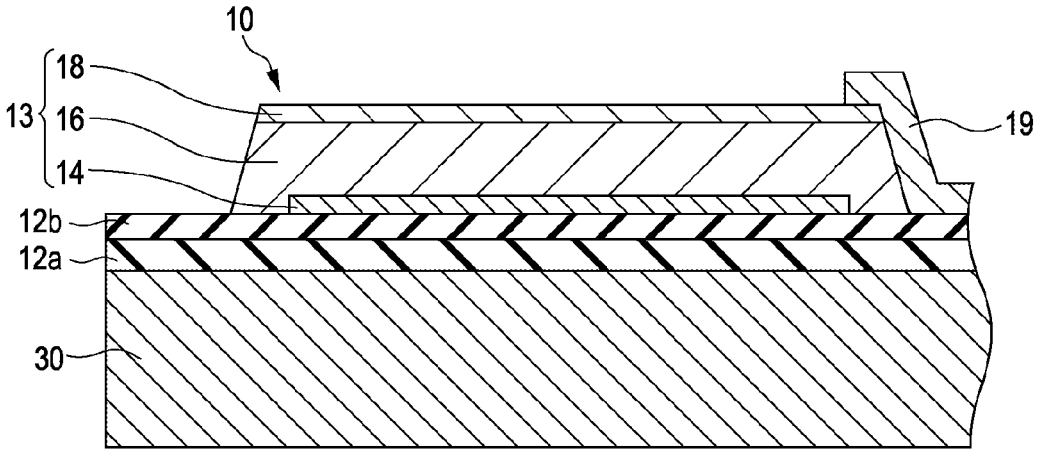
FIG. 5 is a cross-sectional view schematically illustrating a process for manufacturing the liquid ejecting head according to the embodiment of the invention.
Figure 6:
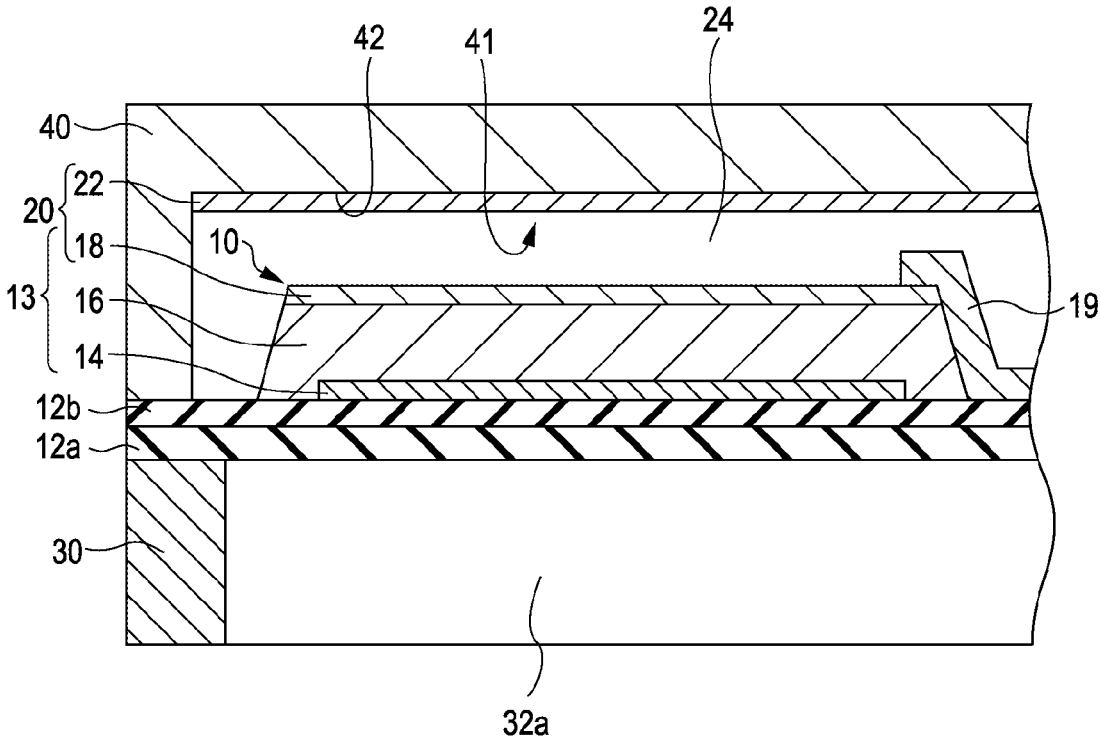
FIG. 6 is a cross-sectional view schematically illustrating the process for manufacturing the liquid ejecting head according to the embodiment of the invention.

Next, a method for manufacturing the liquid ejecting head 100 will be described with reference to the drawings. FIGS. 5 and 6 are cross-sectional views that schematically illustrate a process for manufacturing the liquid ejecting head 100 and correspond to the cross-sectional view in FIG. 2.

As illustrated in FIG. 5, the vibration plates 12*a* and 12*b* are formed on the first substrate 30. The vibration plates 12*a* and 12*b* are obtained in the following manner, for example. The first substrate 30 made of silicon undergoes thermal oxidation to form a silicon oxide layer 12*a*, thereafter a zirconium (Zr) layer is formed by sputtering, then the zirconium layer undergoes thermal oxidation to form a zirconium oxide layer 12*b*.

Next, the piezoelectric element 13 is formed on the vibration plate 12*b*. The first electrode 14 is formed first on the vibration plate 12*b*. The first electrode 14 is formed by, for example, sputtering or the like. Next, the piezoelectric body 16 is formed on the first electrode 14. The piezoelectric body 16 is formed by, for example, the CVD method, the MOD (Metal Organic Deposition) method, the sputtering method or the like. Next, the second electrode 18 is formed on the piezoelectric body 16. The second electrode 18 is formed by sputtering, for example. The first electrode 14, the piezoelectric body 16 and the second electrode 18 can be formed individually in layer patterning processes or formed collectively in multilayer patterning processes. The piezoelectric element 13 is formed in this manner. Next, the wire 19 is formed on the second electrode 18, on the side surface of the piezoelectric body 16 and on the vibration plate 12*b*. The wire 19 is formed by sputtering or the like.

As illustrated in FIG. 6, the second substrate 40, in which the third electrode 22 is formed on the bottom surface 42 of the recess 41, is joined over the piezoelectric element 13. The joining is made, for example, by anodic bonding or using adhesive.

Next, an opening portion 32*a* is formed in the first substrate 30. The opening portion 32*a* can be formed, for example, by etching part of the first substrate 30. The etching of the first substrate 30 can be carried out by using, for example, a potassium hydroxide solution or the like. Before etching the first substrate 30, the film thickness of the substrate 30 may be reduced by grinding a rear surface of the first substrate 30 (a surface opposite the surface where the vibration plates 12*a* and 12*b*).

The nozzle plate 50 including the nozzle openings 52, as illustrated in FIG. 2, is joined to a predetermined position in a lower surface of the first substrate 30, for example, by anodic bonding or using adhesive. Thus, the pressure chamber 32 is formed. At the same time, the reservoir 34 and the supply channel 36 are formed. Next, the drive IC 60 is adhered onto the upper surface of the second substrate 40 with adhesive or the like. Then, the drive IC 60 is electrically connected to the first electrode 14, the third electrode 22, and the wire 19 by wire-bonding or the like.

Through the processes described above, the liquid ejecting head 100 can be manufactured. It should be noted that a method for manufacturing the liquid ejecting head 100 is not limited to the method described above.

3. Liquid Ejecting Apparatus

Figure 7:
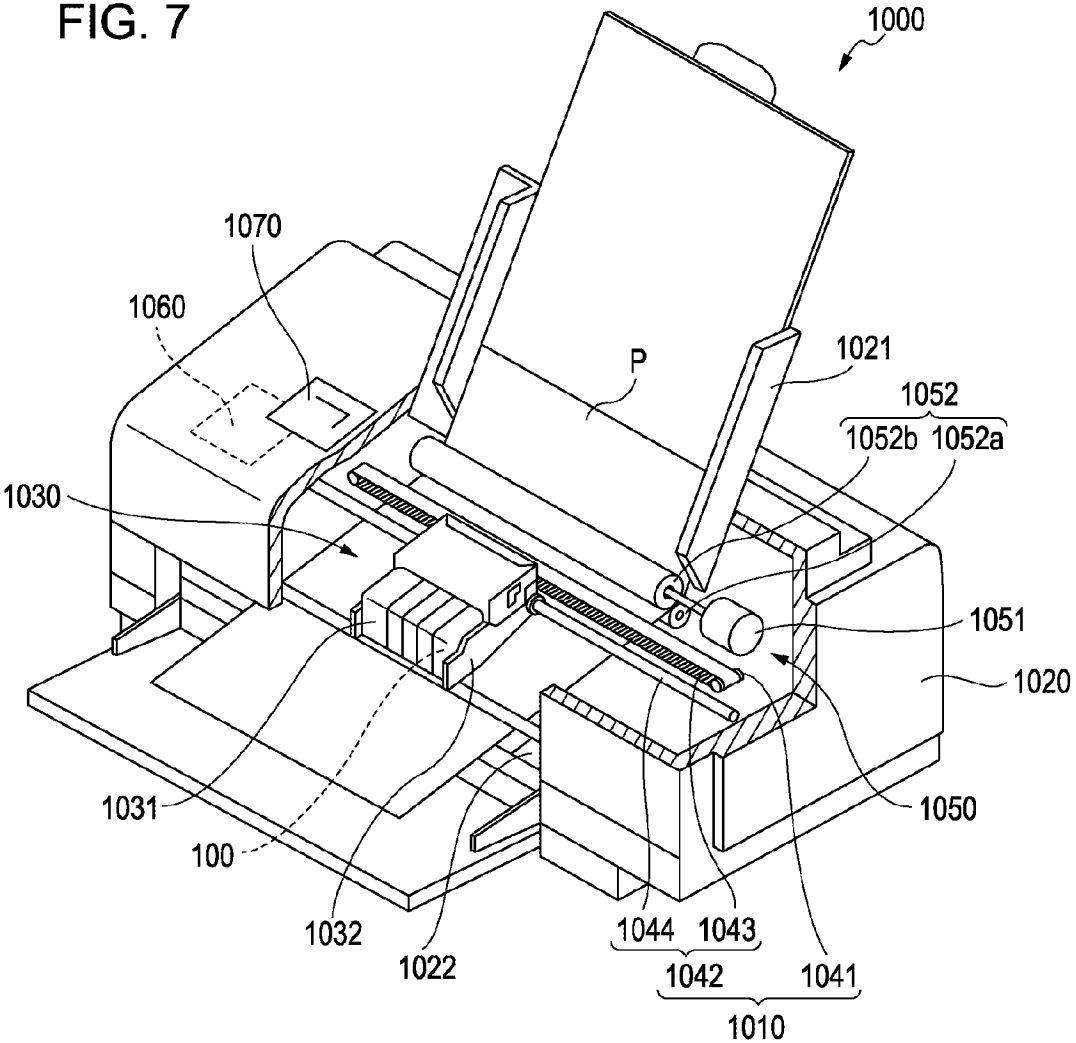
FIG. 7 is a perspective view schematically illustrating a liquid ejecting apparatus according to an embodiment of the invention.

Next, a liquid ejecting apparatus according to an embodiment of the invention will be described. The liquid ejecting apparatus according to the embodiment includes the liquid ejecting head 100 according to the invention. Explanation is made hereinafter in the case where a liquid ejecting apparatus 1000 according to the embodiment is an ink jet printer. FIG. 7 is a perspective view schematically illustrating the liquid ejecting apparatus 1000 according to the embodiment.

The liquid ejecting apparatus 1000 includes a head unit 1030, a driving unit 1010 and a controller 1060. In addition, the liquid ejecting apparatus 1000 may include an apparatus main body 1020, a paper feed unit 1050, a tray 1021 on which recording paper P is placed, a discharge opening 1022 from which the recording paper P is discharged, and an operation panel 1070 disposed on an upper surface of the apparatus main body 1020.

The head unit 1030 includes, for example, an ink jet recording head having the aforementioned liquid ejecting head 100 (hereinafter also referred to as a "head"). The head unit 1030 further includes an ink cartridge 1031 that supplies ink to the head, and a transport unit (carriage) 1032 on which the head and the ink cartridge 1031 are mounted.

The driving unit 1010 can reciprocate the head unit 1030. The driving unit 1010 includes a carriage motor 1041 serving as a driving source of the head unit 1030, and a reciprocating mechanism 1042 that reciprocates the head unit 1030 upon receiving rotary motion of the carriage motor 1041.

The reciprocating mechanism 1042 includes a carriage guide shaft 1044 whose ends are supported by a frame (not illustrated) and a timing belt 1043 that extends parallel to the carriage guide shaft 1044. The carriage guide shaft 1044 supports the carriage 1032 in a state in which the carriage 1032 can reciprocate. Further, the carriage 1032 is fixed to a part of the timing belt 1043. When operation of the carriage motor 1041 causes the timing belt 1043 to move, the head unit 1030 is guided along the carriage guide shaft 1044 and reciprocates. Ink is appropriately discharged from the head during the reciprocation of the head to perform printing onto the recording paper P.

In the embodiment, the liquid ejecting apparatus is exemplified in which printing operation is carried out while the liquid ejecting head 100 and the recording paper P both move. However, the liquid ejecting apparatus according to the invention may have a mechanism in which printing is performed onto the recording paper P while the liquid ejecting head 100 and the recording paper P change their positions relatively to each other. Further, an example in which printing is performed onto the recording paper P is described in the embodiment. However, the printing medium onto which printing can be performed by the liquid ejecting apparatus according to the invention is not limited to paper. Various kinds of media such as cloth, film, and metal can be used and the configuration regarding the media can be appropriately changed.

The controller 1060 controls the head unit 1030, the driving unit 1010 and the paper feed unit 1050.

The paper feed unit 1050 feeds the recording paper P from the tray 1021 toward the head unit 1030. The paper feed unit 1050 includes a paper feed motor 1051 as a driving source and a paper feed roller 1052 that rotates due to rotary motion of the paper feed motor 1051. The paper feed roller 1052 includes a slave roller 1052*a* and a driving roller 1052*b*, which are arranged up and down respectively to face each other while pinching the recording paper P in a feed path therebetween. The driving roller 1052*b* is linked to the paper feed motor 1051. When the controller 1060 drives the paper feed unit 1050, the recording paper P is fed so as to pass through under the head unit 1030.

The head unit 1030, the driving unit 1010, the controller 1060 and the paper feed unit 1050 are installed in the apparatus main body 1020.

The liquid ejecting apparatus 1000 may include the liquid ejecting head 100 according to the invention. Accordingly, the liquid discharge performance of the liquid ejecting apparatus 1000 becomes high.

Although the aforementioned liquid ejecting apparatus 1000 has a single liquid ejecting head 100 and performs printing onto the recording medium using this liquid ejecting head 100, the liquid ejecting apparatus may have a plurality of liquid ejecting heads. In the case where the liquid ejecting apparatus has a plurality of liquid ejecting heads, the liquid ejecting heads may independently carry out printing operation as described above, or may be linked each other so as to serve as a grouped head. A line-type head in which respective nozzle openings in multiple heads are arranged at uniform intervals as a whole can be cited as an example of such grouped head.

As described above, the liquid ejecting apparatus 1000 serving as an ink jet printer has been described as an example of the liquid ejecting apparatus according to the invention. However, it is to be noted that the liquid ejecting apparatus according to the invention can be used for industrial purposes. In such a case, materials in which various functional materials have been processed using a solvent and a dispersion medium so as to achieve appropriate viscosity, or the like may be used as a liquid (liquid material) to discharge. In addition to an image recording apparatus such as the aforementioned printer, the liquid ejecting apparatus according to the invention can be used suitably as a coloring material ejecting apparatus used in the manufacture of color filters of liquid crystal displays or the like, a liquid material ejecting apparatus used in the formation of electrodes and color filters of organic EL displays, surface light emission displays (FEDs), electrophoretic displays or the like, and a bioorganic matter ejecting apparatus used in the manufacture of biochips.

The embodiments of the invention have been explained in detail. However, it is easily understood by those skilled in the art that various changes and modifications may be made in the invention without departing from the appended claims and the stated effects of the invention. Accordingly, such changes and modifications are all included in the spirit and scope of the invention.

What is claimed is:

1. A liquid ejecting head comprising:

a piezoelectric actuator including a first electrode, a piezoelectric body that is formed on a side of the first electrode in a first direction vertical to a surface of the first electrode, and a second electrode that is formed on a side of the piezoelectric body in the first direction; and an electrostatic actuator including the second electrode and a third electrode arranged to face the second electrode with a space therebetween.

2. The liquid ejecting head according to claim 1, further comprising:

a first substrate formed on a side of the piezoelectric actuator in a second direction which is opposite to the first direction; and a second substrate formed on a side of the piezoelectric actuator in the first direction, wherein a passage that communicates with a nozzle opening is formed in the first substrate, a recess is formed on the piezoelectric actuator side of the second substrate, and the third electrode is formed on a bottom surface of the recess.

3. The liquid ejecting head according to claim 2, further comprising: a drive IC that applies voltages between the first and second electrodes and between the second and third electrodes.

4. The liquid ejecting head according to claim 3, wherein the drive IC performs a first control operation in which the drive IC applies a voltage between the first and second electrodes so as to pressurize the inside of the passage and a second control operation in which the drive IC applies a voltage between the second and third electrodes so as to depressurize the inside of the passage.

5. A liquid ejecting apparatus comprising the liquid ejecting head according to claim 4.

6. A liquid ejecting apparatus comprising the liquid ejecting head according to claim 2.

7. The liquid ejecting head according to claim 2, wherein the bottom surface of the recess is a bottom surface of the second substrate.

8. A liquid ejecting apparatus comprising the liquid ejecting head according to claim 3.

9. A liquid ejecting apparatus comprising the liquid ejecting head according to claim 1.

10. The liquid ejecting head according to claim 1, wherein the third electrode is spaced apart from, and not in contact with, the second electrode.

11. A liquid ejecting head comprising:

a piezoelectric actuator comprising a first electrode, a piezoelectric body disposed above the first electrode, and a second electrode disposed above the piezoelectric body; and an electrostatic actuator comprising the second electrode and a third electrode facing the second electrode, wherein the third electrode is spaced apart from, and not in contact with, the second electrode.

12. The liquid ejecting head according to claim 11, further comprising:

a first substrate disposed below the piezoelectric actuator, wherein the first substrate defines a passage in fluid communication with a nozzle opening; and a second substrate disposed above the piezoelectric actuator, wherein the second substrate defines a recess facing the piezoelectric actuator;

wherein the third electrode is disposed on a bottom surface of the second substrate adjacent the recess.

* * * * *